US010712019B2

(12) United States Patent
Adam et al.

(10) Patent No.: US 10,712,019 B2
(45) Date of Patent: Jul. 14, 2020

(54) COMBINED DEVICE WITH COOKING SURFACE AND FUME EXTRACTOR

(71) Applicant: BSH Hausgeräte GmbH, Munich (DE)

(72) Inventors: Julien Adam, Strasbourg (FR); Nicolas Chabut, Gertwiller (FR); Sebastien Flesch, Gerstheim (FR)

(73) Assignee: BSH Hausgeräte GmbH, Munich (DE)

( * ) Notice: Subject to any disclaimer, the term of this patent is extended or adjusted under 35 U.S.C. 154(b) by 79 days.

(21) Appl. No.: 15/744,898

(22) PCT Filed: Aug. 5, 2016

(86) PCT No.: PCT/EP2016/068715
§ 371 (c)(1),
(2) Date: Jan. 15, 2018

(87) PCT Pub. No.: WO2017/029128
PCT Pub. Date: Feb. 23, 2017

(65) Prior Publication Data

US 2018/0209662 A1 Jul. 26, 2018

(30) Foreign Application Priority Data

Aug. 19, 2015 (EP) ..... 15290206

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2035; F24C 15/2042
See application file for complete search history.

(56) References Cited

U.S. PATENT DOCUMENTS 2,674,991 A 4/1954 Schaefer
3,587,555 A * 6/1971 Cerola ..... F24C 15/18 126/11
4,431,892 A * 2/1984 White ..... F24C 15/101 126/299 D (Continued)

FOREIGN PATENT DOCUMENTS

CN 202442381 U 9/2012
DE 202013005303 U1 6/2013

(Continued)

OTHER PUBLICATIONS

National Search Report CN201680048595.5 dated Nov. 20, 2018.

(Continued)

*Primary Examiner* — Alfred Basichas
(74) *Attorney, Agent, or Firm* — Michael E. Tschupp; Andre Pallapies; Brandon G. Braun

(57) ABSTRACT

A combined device includes a cooking surface having a recess. Arranged underneath the cooking surface is a fume extractor to extract air from a space above the cooking surface via the recess. The fume extractor forms with the cooking surface an assembly unit and includes a fan with an air inlet opening. The fan is arranged such that the air inlet opening of the fan faces the cooking surface. The air inlet opening of the fan, when viewed in a top view upon the cooking surface, is located at least partially underneath the recess.

15 Claims, 4 Drawing Sheets

(56) References Cited

U.S. PATENT DOCUMENTS

| | | | |
|---|---|---|---|
| 4,736,729 | A | 4/1988 | Beach |
| 4,899,028 | A | 2/1990 | Arai et al. |
| 6,455,818 | B1 | 9/2002 | Arntz et al. |
| 2006/0150965 | A1 | 7/2006 | Kim et al. |
| 2010/0163549 | A1 | 7/2010 | Gagas et al. |
| 2014/0048057 | A1 | 2/2014 | Bruckbauer |

FOREIGN PATENT DOCUMENTS

| | | | |
|---|---|---|---|
| DE | 102013007722 | A1 | 11/2014 |
| JP | H04240317 | A | 8/1992 |
| WO | 2013123928 | A2 | 8/2013 |

OTHER PUBLICATIONS

International Search Report PCT/EP2016/068715 dated Sep. 29, 2016.
Report of Examination EP 16 747 781.9 dated Jul. 11, 2019.

* cited by examiner

COMBINED DEVICE WITH COOKING SURFACE AND FUME EXTRACTOR

CROSS-REFERENCES TO RELATED APPLICATIONS

This application is the U.S. National Stage of International Application No. PCT/EP2016/065536, filed Jul. 1, 2016, which designated the United States and has been published as International Publication No. WO 2017/021075 A1 and which claims the priority of German Patent Application, Serial No. 10 2015 214 628.6, filed Jul. 31, 2015, pursuant to 35 U.S.C. 119(a)-(d).

BACKGROUND OF THE INVENTION

The present invention relates to a combined device with cooking surface and fume extractor.

In kitchens it is known to use so-called downdraft fans instead of fume extractor hoods which are arranged above a cooking surface, for example on the room wall or ceiling, in order to extract fumes and vapors which are produced during cooking. Such downdraft ventilation is disclosed, for example, in DE 10 2013 007 722 A1. In this case, a cooking vapor inlet opening placed in the cooking surface plane is connected via an exhaust air channel system to a vacuum source. The downdraft ventilation in this case is provided as a separate appliance between two cooking surfaces or adjacent to a cooking surface. A drawback with this downdraft ventilation is in the large space requirement which is present due to the exhaust air channel system to be provided. Additionally, in this case the space between the inlet opening and the vacuum source is large so that increased requirements are set for the vacuum source which, in particular, may be constituted by a suction fan.

A cooking surface with central extraction of cooking fumes in the downward direction is also disclosed in WO 2012/146237 A1. In this cooking surface, one or more recesses is or are incorporated in the region around the geometric surface center of gravity. Devices are provided underneath the cooking surface for the extraction of cooking fumes. The devices for the extraction of cooking fumes are preferably constituted by radial fans which are fastened to the lower face of a cooking surface housing and via which air is extracted upwardly out of cooking fume extraction chambers located thereunder.

A drawback with this arrangement is that the requirements for radial fans for producing a sufficient vacuum are increased, in particular, since the flow of cooking fumes has to be deflected.

It is, therefore, the object of the present invention to provide a combined device in which fumes and vapors may be extracted from the space above the cooking surface in a simple and reliable manner with a preferably simple construction of the combined device.

The invention is based on the recognition that this object may be achieved by the fan of the fume extractor being arranged in a combined device, such that said fan is located directly underneath a recess in the cooking surface and that it is possible for air to flow into the air inlet opening of the fan as directly as possible from above.

According to the invention, therefore, the object is achieved by a combined device which comprises a cooking surface having at least one recess and a fume extractor arranged underneath the cooking surface in order to extract air from the space above the cooking surface via the at least one recess. The combined device is characterized in that the fume extractor has a fan with an air inlet opening, the fan being arranged in the combined device such that the air inlet opening of the fan faces the cooking surface, in the top view of the cooking surface the air inlet opening of the fan being located at least partially underneath at least one of the at least one recess and the fume extractor and the cooking surface form an assembly unit.

The combined device according to the invention comprises a cooking surface and a fume extractor. In particular, these two components of the combined device are designed as an assembly unit, in other words a structural unit. This means that the two components of the combined device are fastened indirectly or directly and may be installed as an assembly unit, for example, in a work surface. The combined device thus constitutes an assembled or premounted unit or a unit which is able to be premounted.

The cooking surface according to the invention comprises at least one heating element and preferably a cover plate. The cover plate covers the at least one heating element from above. The size of the heating element or the working radius thereof determines the size of the cooking zone or cooking point in the cooking surface on which pots or other cooking vessels may be placed in order to be heated. The heating element may be constituted, for example, by an induction module. Alternatively, however, the heating element may also be an electronic heating element in the form of a heating coil. Finally, it is also possible that at least one of the heating elements of the cooking surface is constituted by a gas burner. In the last-mentioned embodiment the cover plate does not cover the heating element but at the location of the heating element the cover plate comprises a through-opening for the passage of the burner head.

According to the invention, the fume extractor comprises a fan and preferably additionally an air duct for conducting the air out of the combined device after it has exited the fan.

According to the invention, at least one recess is provided in the cooking surface. The recess may preferably be incorporated in the cover plate of the cooking surface. However, it is also within the scope of the invention that the recess or the recesses is or are formed by the intermediate space between adjacent heating elements of the cooking surface and a cover plate is not provided but, for example, simply a frame for the heating elements. Additionally, it is possible that outside the cover plate the cooking surface has a housing in which the heating elements are received. In this embodiment, the at least one recess is preferably incorporated in the upper face and the lower face of the housing of the cooking surface.

The fume extractor according to the invention is arranged underneath the cooking surface. "Arranged underneath the cooking surface" denotes a fume extractor in which at least one part of the fan of the fume extractor is located further down than the lowest point of the cooking surface. In any case, however, the fume extractor is arranged underneath the upper face of the cooking surface. If the upper face of the cooking surface, as preferred according to the invention, is formed by a cover plate, the fume extractor is arranged underneath the cover plate. The fan of the fume extractor may be arranged, for example, between two heating elements of the cooking surface or completely offset downwardly relative to the heating elements.

Directional information such as "above" and "underneath" refer to the combined device in the assembled and installed state, i.e. in the state in which said combined device is incorporated, for example, in a horizontal work surface.

The air from the space above the cooking surface and, in particular, fumes and vapors which are produced during cooking, according to the invention are extracted via the at least one recess of the cooking surface. The recess in the cooking surface in this case may be the suction opening of the combined device. The "suction opening of the combined device" in this case denotes the opening via which air enters the interior of the combined device.

According to the invention, the fume extractor of the combined device comprises a fan. The fan which also may be denoted as the fan or suction fan, preferably comprises a fan housing which is designed, for example, as a spiral housing or worm housing and is also denoted as a fan housing. A fan wheel is received in the fan housing, said fan wheel being driven via a motor which is also received in the fan housing. The fan housing has an air inlet opening via which suctioned air is able to pass toward the fan wheel. Moreover, the fan housing has an air outlet opening via which air may be discharged radially into a discharge channel or directly out of the combined device. In a fan which is also constituted by a radial fan, the air inlet opening is preferably located in the region of the axis of the fan wheel.

According to the invention, the fan is arranged in the combined device such that the air inlet opening of the fan, and in particular of the fan housing, faces the cooking surface. "Faces the cooking surface" denotes an air inlet opening via which air may be suctioned from above into the fan and thus the fan housing. In particular, "faces the cooking surface" thus denotes an air inlet opening which is located on the fan and thus above the fan housing. Preferably, the air inlet opening is parallel to the cooking surface and, in particular, to a cover plate of the cooking surface. In this case, the air inlet opening is thus located in the horizontal plane and is oriented upwardly. However, an air inlet opening on the upper face of the fan which is inclined relative to the horizontal may also be regarded as facing the cooking surface. The angle of inclination in this case, however, is preferably less than 90° and further preferably less than 45°.

According to the invention, in a top view of the cooking surface the air inlet opening of the fan is located at least partially underneath at least one of the at least one recess. This means that in a vertical projection of the recess of the fan located thereunder, the air inlet opening of the fan is located at least partially in the surface of the recess. By this alignment, the flow path of the air suctioned via the recess to the air inlet opening is minimized and a sufficient extraction of air from the space above the cooking surface may be ensured.

According to the invention it is possible, in addition to the one fan which is arranged underneath the recess, to provide one or more additional fans, for example in the edge regions of the cooking surface. With a suitable layout of the fan arranged underneath the recess, however, additional fans are not necessarily required.

Since according to the invention a combined device is provided in which a fan which is arranged underneath the recess is used, the air inlet opening thereof facing the cooking surface, a series of advantages may be achieved. Since the air inlet opening faces the cooking surface, firstly the suctioning of air via the recess(es) in the cooking surface may be simplified. In particular, only a slight deflection of the air flow is required. Thus, the requirements for the power of the fan are reduced. Additionally, by the alignment of the fan with an upwardly facing air inlet opening, the size of the fan may be selected irrespective of the size of the heating elements or the housing of the cooking surface. The fan may be fastened to the side of the fan housing which opposes the air inlet opening. In contrast to the prior art in which the fans are fastened on the side opposing the air inlet opening to the lower face of the housing of the heating element, in the combined device according to the invention therefore a larger fan may also be used. The fan in this case may be fastened, for example, to the base of an appliance housing of the combined device, the surface thereof generally corresponding to the surface of the cooking surface. Additionally, according to the invention it is also possible to fasten the fan to the cooking surface, in particular to the lower face of the cooking surface and, in particular, a lower face of a cooking surface housing, via the same side in which the air inlet opening is provided in a region around the air inlet opening. Also in this embodiment, since the air inlet opening of the fan faces the cooking surface, i.e. is oriented upwardly, the size of the fan may be selected to be large and the fan may be fastened, for example, underneath two heating elements which are located on opposing sides of the recess. Thus a potentially larger fan may also produce the desired airflow at a lower speed and the noise development of the fan is also therefore reduced.

According to the invention since the cooking surface and the fume extractor are also integrated in one appliance, and thus form an assembly unit, the mounting and/or the installation is simplified. In particular, the cooking surface and the fume extractor may be incorporated and optionally received as a unit in a work surface or other surface. Moreover, by the integration of the two components in a combined device the required overall height is reduced since the elements of the components may be provided to be aligned relative to one another in the combined device. The overall height of the combined device according to the invention may, for example, be 15 to 30 cm and preferably 20 cm. Thus the combined device may be integrated in a simple manner in a kitchen.

According to a preferred embodiment, in a vertical top view of the cooking surface, the entire air inlet opening is located underneath the recess, i.e. in the surface of the recess. If a plurality of recesses are provided in the cooking surface, in a vertical top view, the fan may be located underneath one of the recesses or even underneath a plurality of recesses. Hereinafter, reference is substantially made to an embodiment having one recess in the cooking surface. If nothing else is specified, the statements made also apply to an embodiment of the combined device with a plurality of recesses. Since, in a vertical top view of the cooking surface, the air inlet opening is located entirely in the surface of the recess, the extraction of air may be further optimized.

According to a preferred embodiment, the fan is arranged in the middle of the surface of the combined device. The middle of the surface of the combined device, in this case, is understood as the middle of the surface which covers the combined device in a top view. In particular, therefore, the fan according to the invention is arranged at a point which is located underneath the middle of the surface of the upper face of the cooking surface and, in particular, underneath the middle of the surface of the cover plate of the cooking surface. By the central arrangement of the fan in the combined device, a uniform extraction of air may be ensured. Also in the case of one or more recesses which are incorporated in the surface of the cooking surface, for example in the middle of the surface or adjacent thereto, a reliable and uniform extraction may be implemented via a centrally arranged housing. Additionally, with a central arrangement of the fan, the required overall height for the combined device may be minimized. Generally, no heating elements are provided in the middle region of the cooking surface, said heating elements generally extending from the upper face of the cooking surface, in particular downwardly from a cover plate, and thus making use of part of the space in the combined device. Thus with a centrally arranged fan, the entire space between the upper face of the cooking surface and the lower face of the combined device is available for receiving the fan and the optionally provided filter units.

According to a further preferred embodiment, at least one of the at least one recess extends over the middle of the surface of the cooking surface. In one embodiment, in this case a single recess may be incorporated in the cooking surface. This recess may, for example, have a round cross section. Alternatively, however, the recess in this embodiment may also have a quadrangular, in particular rectangular, cross section for example. In this case, the recess may be a square recess in the middle of the surface of the cooking surface. Preferably, however, the recess in this embodiment extends over the depth of the cooking surface, i.e. it forms a wide slot which extends from the region of the front face of the cooking surface in the direction toward the region of the rear face of the cooking surface. By the provision of a recess which extends over the middle of the surface of the cooking surface, an alignment of the recess may be ensured relative to the cooking zone(s) of the cooking surface in which fumes and vapors from cooking vessels on the cooking zone(s) of the cooking surface may be reliably extracted. If, for example, four cooking zones are formed in the cooking surface, two cooking zones may be located to the right and two cooking zones may be located to the left from a centrally incorporated recess extending over the depth of the cooking surface. Since the fan and, in particular, the upwardly oriented air inlet opening of the fan housing, in a vertical top view of a recess extending above the middle of the surface of the cooking surface, is located at least partially in the recess, the air guidance is further simplified, since a deflection of the airflow is not required and/or just a slight deflection of the airflow is sufficient in order to guide the air toward the air inlet opening.

According to one embodiment, the combined device comprises at least one cover for covering at least one part of the at least one recess. The shape of the cover is adapted to the shape of the recess in the cooking surface. In the case of a round recess, generally a round cover is used. With a rectangular recess in the cooking surface, preferably a rectangular cover is used.

The cover is preferably releasable from the combined device, in particular removable from the cooking surface or a filter unit.

The size of the cover may correspond to the size of the recess. In this case, the ingress of liquids and other contaminants into the recess(es), in the state in which the fume extractor is not in operation, is entirely prevented by the cover.

According to a preferred embodiment, however, at least in one surface direction the cover has a smaller dimension than the recess of the cooking surface. The "surface direction" in this case denotes the length and width of a quadrangular cover and the diameter in the case of a round cover. Since the cover has a smaller dimension in at least one surface direction, at least one gap is formed between the edge of the recess and the edge of the cover. Air may be suctioned via this gap into the combined device. The gap thus constitutes the suction opening of the combined device. At the same time, however, at least one part of the recess is covered by the cover and thus contaminants are prevented from dropping in and the ingress of liquids into the combined device is prevented. In particular, with the arrangement of the fan according to the invention and the recess preferably arranged above the air inlet opening, the prevention of the ingress of contaminants and liquids is of particular importance. Without a cover, the direct ingress of contaminants and liquids from the recess into the air inlet opening of the fan located thereunder might be possible, whereby the fan might be damaged.

According to one embodiment, for example in the case of an elongated quadrangular cross section of the recess, the length of the cover may correspond to the length of the recess but the width of the cover may be smaller than the width of the recess. Depending on the positioning of the cover on the recess, on the one hand, a single lateral gap may be formed via which air may enter the combined device. Alternatively, however, two lateral gaps which extend over the length of the recess may also be formed. The last-mentioned embodiment is preferred, in particular in the preferred embodiment in which a recess extends over the middle of the surface of the cooking surface, since as a result a specific extraction is possible from the left-hand and right-hand cooking zones. The embodiment in which only one gap is formed may be used, for example, in an embodiment in which recesses extend along the side edges of the cooking surface in the depth direction. In this case, the cover is positioned on the recess such that the gap formed thereby is located on the side of the recess which adjoins the cooking zones or is in the vicinity thereof.

According to the invention, however, it is also possible that the cover has dimensions which differ in all surface directions from the dimensions of the recess onto which the cover is intended to be applied. For example, a round cover may be used which has a smaller diameter than the diameter of a round recess onto which the cover is intended to be applied. Even with a rectangular cover, both the width and the length of the cover may be smaller than the corresponding dimensions of the recess. As a result, a peripheral gap is formed around the cover, air being able to enter the recess through said gap.

According to a preferred embodiment, a filter unit is provided between the fan of the fume extractor and the cooking surface. The filter unit is located, in particular, between the at least one recess of the cooking surface and the air inlet opening of the fan. "The filter unit" in this case denotes a unit which is releasably connected to the combined device. In particular, the filter unit is introduced into the recess or the filter units are introduced into the recesses. The filter unit may be held on the recess, preferably on the edge of the recess. The filter unit in this case is practically suspended in the recess. According to the invention, the filter unit comprises a filter element. Additionally, the filter unit preferably comprises at least one filter holder by means of which the filter element may be held on the combined device, for example on the recess of the cooking surface. The filter element may be a flat filter element, for example a filter plate or a filter mat.

Alternatively or additionally, however, filter elements which describe a hollow body may also be used. For example, a round length of pipe or a rectangular length of pipe made of filter material may be used. Also other shapes, such as for example two filter elements arranged so as to be inclined to one another, may be used in the filter unit.

The filter material of the filter element may be expanded metal, braided metal or the like.

According to a preferred embodiment, the filter unit comprises a collection area for liquids. "Collection area for liquids" denotes a region in which liquids, which are discharged from the filter element and/or enter the interior of the combined device in a different manner, may be at least partially collected. The collection area, therefore, preferably has the shape of a trough or groove. Particularly preferably, the collection area is configured on the filter holder. The filter element is held via the filter holder on the combined device, in particular on the recess in the cooking surface. Since the collection area is configured on the filter holder, a series of advantages may be achieved. Firstly, the filter unit is releasably incorporated in the combined device. Thus when removing the filter unit, for example for cleaning the filter element, the collection area may also be emptied and cleaned. Additionally, when providing the collection area in the filter holder and thus in the vicinity of the filter element, liquids and other contaminants may be reliably collected from the filter element itself.

The embodiment in which the filter unit comprises a collection area for liquids is of particular importance in the arrangement of the fan according to the invention underneath the recess. Even if, as preferably provided, a cover covers at least part of the recess, it may also result in the ingress of contaminants and, in particular, liquids via the gap present between the cover and the recess. By the provision of a collection area on the filter unit, the ingress into the fan housing of contaminants and liquids which enter the combined device via this gap, is prevented. For this reason, the collection area is preferably provided on the filter unit such that in a vertical projection said collection area is located at least underneath the gap between the recess and the cover, in the incorporated state of the filter unit in the combined device and when the cover is applied.

According to a further preferred embodiment, the combined device comprises an overflow container in addition to a collection area for liquids. "Overflow container" denotes a component into which liquids which overflow from the collection container may be received. The overflow container is, therefore, preferably arranged at least partially underneath the filter unit and preferably underneath the collection area of the filter unit. The overflow container may be fixedly connected to the combined device, i.e. constitute a fixed housing part. The overflow container may be fastened, for example, to the lower face of the cover plate of the cooking surface, to the heating elements of the cooking surface, to the fan housing or to the recess of the cooking surface. In the embodiment in which the combined device comprises an overflow container, at least one overflow opening may be provided in the filter element in the upper region of the collection area. Alternatively, however, it is also possible that the collection area has an upper edge via which the liquid may enter the overflow container when the maximum filling level of the collection area is reached.

Since in addition to the collection area an overflow container is provided on the filter unit, the size of the collection area may be kept smaller. The overflow container may then be used in situations in which a large quantity of liquids enter the combined device. This is the case, for example, when liquid is spilled onto the cooking surface or when liquids boil over.

This additional overflow container for liquids is advantageous, in particular, in the arrangement of the fan according to the invention which is aligned with the recess. Without the provision of an overflow container, in this preferred embodiment of the combined device, liquids could otherwise enter the fan or enter a base of the combined device, from where these liquids are only able to be removed with difficulty.

The overflow container is preferably arranged above the fan housing. A central opening which is preferably aligned with the air inlet opening of the fan housing is provided in the overflow container. The overflow container may, therefore, be formed around the air inlet opening. However, it is also possible that the overflow container is arranged adjacent to the fan housing.

The cooking surface and the fume extractor according to the invention may be fastened indirectly or directly to one another. With a direct fastening, for example, the side of the fan of the fume extractor in which the air inlet opening is provided may be fastened to the cooking surface, for example to the lower face of a cooking surface housing.

An indirect fastening of the cooking surface and the fume extractor may be implemented, for example, by an appliance housing. In this embodiment, the cooking surface and the fume extractor may be received in a common appliance housing. In this case, the appliance housing may have, in particular, a trough shape. At the top the appliance housing is closed by the cooking surface and, if provided, in particular closed by the cover plate of the cooking surface. According to the invention, the cover plate may be a glass ceramic plate. An air outlet is additionally incorporated in the appliance housing. The air outlet may be provided, for example, on the rear face of the appliance housing. Alternatively, however, it is also possible that the air outlet is incorporated on one of the side walls of the appliance housing or is incorporated in the base of the appliance housing. Preferably at least the fume extractor of the combined device is fastened in the appliance housing. The cooking surface may be incorporated either from above into the appliance housing and, for example, bear with the cover plate against the upper edge of the walls of the appliance housing. Alternatively or additionally, however, the heating elements of the cooking surface, for example, may also be fastened or held on the inner face of the appliance housing.

Since in the combined device the fume extractor and the cooking surface are connected together indirectly or directly, both the assembly and the mounting of the combined device is simplified. During the assembly, with the provision of an appliance housing, the relative position between the components of the fume extractor and the cooking surface is already predetermined. Thus, for example, the alignment of the recess with the fan may be ensured. During mounting, in particular when introduced into a work surface, the components of the fume extractor and the cooking surface incorporated in the appliance housing or the fume extractor and the cooking surface fastened together, may be incorporated in one mounting step in a working surface or a different surface. If the cover plate constitutes a component of the cooking surface which is separate from the heating elements, this cover plate may be optionally positioned retrospectively.

According to a preferred embodiment, the cooking surface and the fume extractor of the combined device have a common electrical power connection. This power connection may be provided, for example, on the appliance housing and may supply power to the electrical components of the fume extractor and the cooking surface. Moreover, the activation of the components of the fume extractor and of the cooking surface may also be implemented by a common control device. For example, in this case the fume extractor may be actuated depending on the operating state of the cooking surface.

According to one embodiment, the fume extractor and the cooking surface are received in a common appliance housing and the fan of the fume extractor is fastened to the base of the appliance housing. In this case, in particular, the side of the fan housing which is located opposite the air inlet opening is fastened to the base of the appliance housing. This embodiment has the advantage that the fan may be securely held on the base of the appliance housing. Additionally, in this embodiment the assembly of the combined device is further simplified. In particular, for example, the fan may be fastened to the base of the appliance housing before the cooking surface is incorporated in the appliance housing. The base in this state is still freely accessible and the assembly is thus simplified. In the alternative embodiment in which the combined device does not have a common housing for the fume extractor and the cooking surface, the assembly may also be implemented such that the fan and, in particular, the fan housing are fastened to the cooking surface from underneath, i.e. from the side of the cooking surface which opposes the cover plate.

The fan of the fume extractor of the combined device according to the invention is preferably constituted by a radial fan.

BRIEF DESCRIPTION OF THE DRAWINGS

The invention is described again in more detail hereinafter with reference to the accompanying figures, in which.

DETAILED DESCRIPTION OF EXEMPLARY EMBODIMENTS OF THE PRESENT INVENTION

Figure 1:
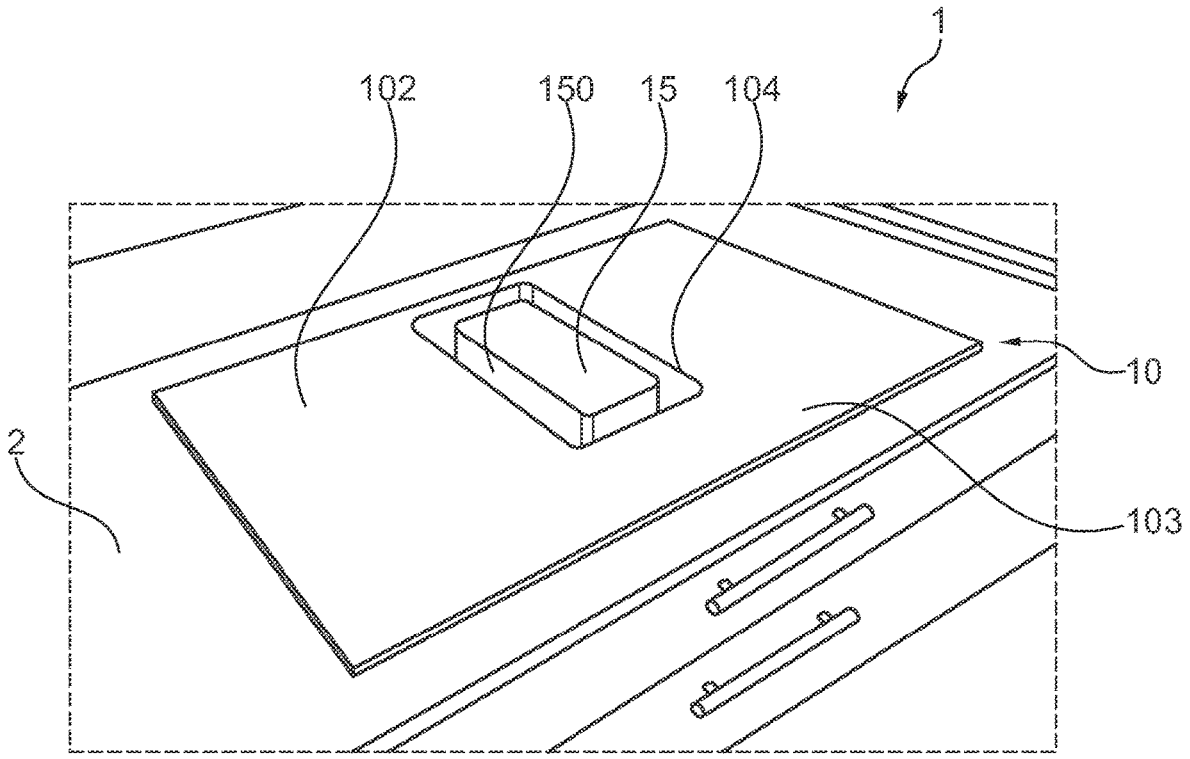
FIG. 1: shows a schematic perspective top view of a first embodiment of the combined device according to the invention.

In FIG. 1 a first embodiment of a combined device 1 according to the invention is shown. The combined device 1 comprises a cooking surface 10 and a fume extractor, not visible in FIG. 1. The combined device 1 is incorporated in a work surface 2. The cooking surface 10 is arranged in the upper region of the combined device 1. In the embodiment shown, the cooking surface 10 comprises a cover plate 103. Heating elements (see FIG. 4) are arranged underneath the cover plate 103. The region of the cover plate 103 in which a heating element is arranged underneath the cover plate 103, i.e. on which food to be cooked may be heated, is also denoted as the cooking zone 102 or cooking point.

As visible from FIG. 1, a recess 104 is incorporated in the middle of the surface of the cooking surface 10 and, in particular, in the cover plate 103. The recess 104 has a quadrangular cross section and extends over the middle of the surface of the cover plate 103. In the embodiment shown, the recess 104 extends in the depth direction of the combined device 1. In the embodiment shown, the recess 104 is offset to the rear. This means that the spacing between the front edge of the combined device 1 and, in particular, the cover plate 103 and the front edge of the recess 104 is greater than the spacing between the rear edge of the combined device 1 and, in particular, the cover plate 103 and the rear edge of the recess 104. However, it is also within the scope of the invention that in the depth direction of the combined device 1 the recess 104 is incorporated centrally in the combined device 1 and, in particular, in the cover plate 103.

A cover 15 which covers a part of the recess 104 is provided in the recess 104. The length and width of the cover 15 are in this embodiment smaller than the length and width of the recess 104. The length of the recess 104 and the cover 15 denotes the surface direction which is located in the depth direction of the combined device 1, i.e. in the direction between the front face and the rear face of the combined device 1. The cover 15 in the first embodiment is located in the plane of the cover plate 103.

A fan of the fume extractor of the combined device is arranged underneath the recess 104, not visible in FIG. 1.

Figure 2:
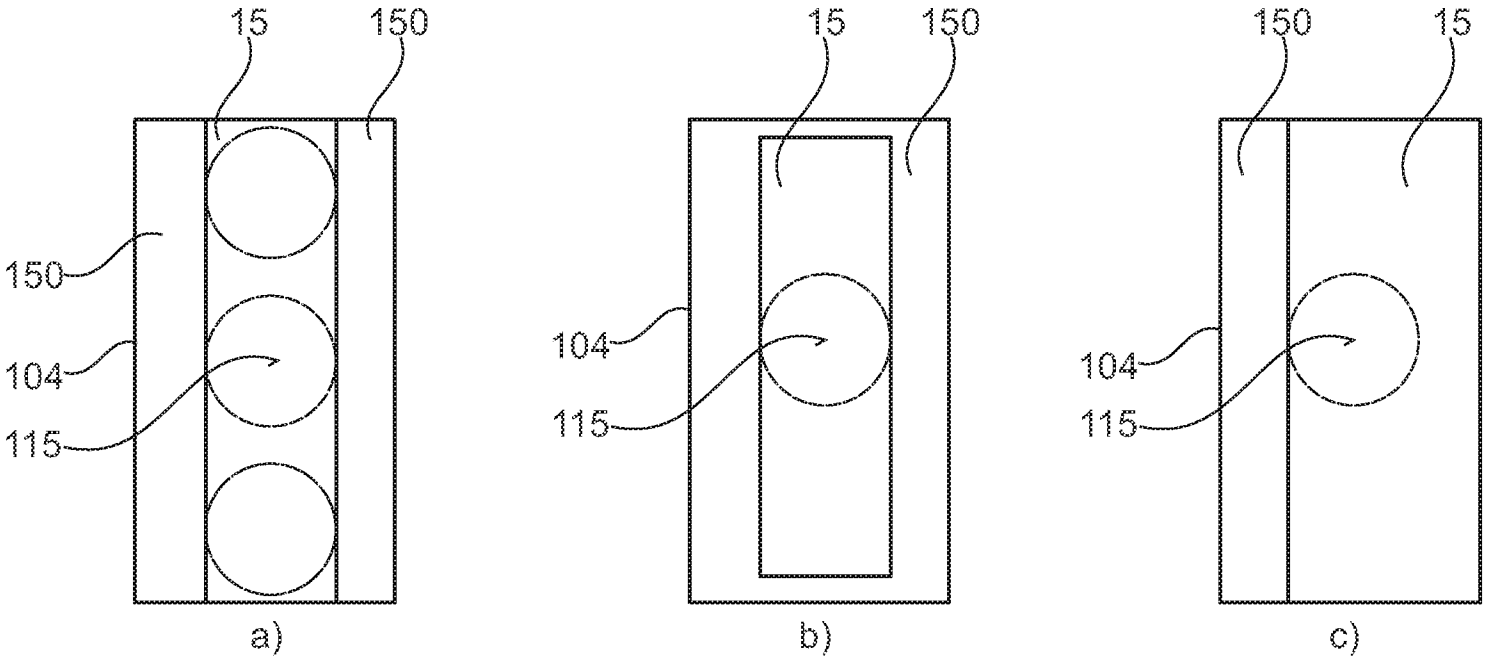
FIGS. 2*a* to 2*c*: show schematic views of different embodiments of covers on a recess of the combined device according to the invention.

Three embodiments of the arrangement of a cover 15 in a recess 104 of a combined device 1 according to the invention are shown in FIGS. 2*a* to 2*c*. In FIG. 2*a* the cover 15 has a length which corresponds to the length of the recess 104. The width of the cover 15, however, is smaller than the width of the recess 104. The cover 15 is arranged centrally in the recess 104. As a result, in each case a gap 150 is formed between the lateral edges of the cover 15 and the lateral edges of the recess 104. A fan is arranged underneath the recess 104 in the combined device 1, the air inlet opening 115 of the fan being located in the surface of the recess 104 and being covered by the cover 15, in the embodiment shown in a top view of the recess 104.

In FIG. 2*c* the cover 15 also has a length which corresponds to the length of the recess 104. The width of the cover 15 is smaller than the width of the recess 104. The cover 15 is arranged at the side in the recess 104. As a result, a gap 150 is formed between one of the lateral edges of the cover 15 and the corresponding lateral edge of the recess 104. A fan is arranged underneath the recess 104 in the combined device 1, the air inlet opening 115 of the fan being located in the surface of the recess 104 and being covered by the cover 15, in the embodiment shown in a top view of the recess 104.

In FIG. 2*b* the cover 15 has a length which is smaller than the length of the recess 104. The width of the cover 15 is also smaller than the width of the recess 104. The cover 15 is arranged centrally in the recess 104. As a result, in each case a gap is formed between the lateral edges of the cover 15 and the lateral edges of the recess 104. Additionally, in each case a gap 150 is formed between the front edge of the recess 104 and the front edge of the cover 15 and between the rear edge of the recess 104 and the rear edge of the cover 15. The resulting gap 150 is a peripheral gap 150. A fan is arranged underneath the recess 104 in the combined device 1, the air inlet opening 115 of the fan being located in the surface of the recess 104 and being covered by the cover 15, in the embodiment shown in a top view of the recess 104.

In FIGS. 2*a* to 2*c*, in each case the air inlet opening 115 in the depth direction is arranged centrally underneath the recess 104 which means that the fan 110 is located underneath the recess 104 in the middle of the depth of the recess 104. This arrangement is advantageous since the extraction is able to take place uniformly via the recess 104. According to the invention, however, it is also possible to arrange the fan offset to the front or to the rear relative to the middle of the depth direction of the recess 104. This is indicated in FIG. 2*a* by the air inlet openings shown in dashed lines. Moreover, it is also possible to provide a plurality of fans underneath the recess 104. For example, according to FIG. 2*a*, three fans 110 may be arranged so as to be distributed over the depth of the recess 104. Also the provision of just two fans is possible according to the invention, for example the front and rear fan, the air inlet openings thereof being shown in dashed lines in FIG. 2*a*.

Figure 3:
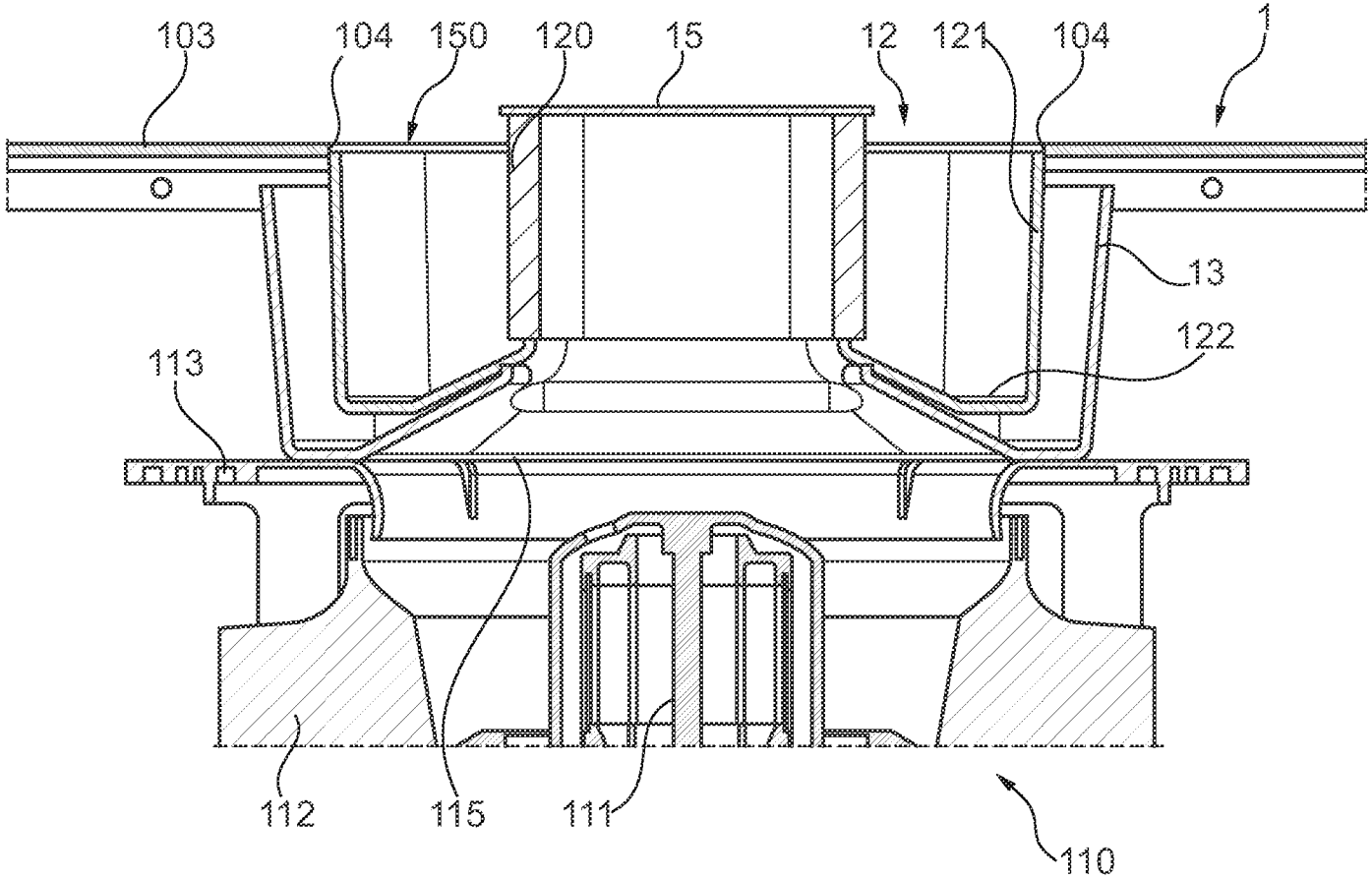
FIG. 3: shows a schematic sectional view of a second embodiment of the combined device according to the invention.

In FIG. 3, a second embodiment of the combined device according to the invention 1 is shown in a sectional view. In this embodiment, in contrast to the first embodiment which is shown in FIG. 1, the cover 15 is provided at a height which is located above the plane of the upper face of the cooking surface 10, in particular the cover plate 103. Additionally, in the view shown in FIG. 3 the construction of the combined device 1 is shown in more detail. The embodiment of the combined device according to FIG. 1 may also have this construction.

The fan 110 of the fume extractor 11 which is arranged underneath the recess 104 in the cooking surface 10, in particular the cover plate 103, is shown in FIG. 3. Additionally in FIG. 3 a filter unit 12 is shown between the recess 104 and the fan 110. The fan 110 comprises a motor 111 which drives a fan wheel 112. The fan wheel 112 and the motor 111 are received in a fan housing 113. The fan housing 113 has an air inlet opening 115 on the upwardly facing side, i.e. the side facing the cooking surface 10. The fan 110 is constituted by a radial fan in which the air axially suctioned via the air inlet opening 115 into the fan housing 113 is discharged again in the radial direction via an air outlet opening (not shown) on the fan housing 113.

The air inlet opening 115 of the fan housing 113 is aligned with the recess 104 in the cover plate 103 such that the air inlet opening 115, in a vertical top view of the cooking surface 10, is entirely located within the surface of the recess 104.

In spite of this alignment of the air inlet opening 115, in the mounted state of the combined device 1 the air inlet opening is not visible to the user. The filter unit 12 is namely arranged above the fan housing 113. The filter unit 12 comprises, in the embodiment shown, a filter holder 121 as well as a filter element 120. Additionally, the combined device 1 comprises an overflow container 13. In the embodiment shown, the filter element 120 constitutes a hollow body in which the filter surfaces of the filter element 120 extend vertically. The filter element 120 is held on a filter holder 121 which has an annular trough shape. The outer walls of the filter holder 121 are fastened on the upper face thereof to the cover plate 103. For example, the filter holder 121 may bear against the cover plate 103 via chamfers on the edge of the recess 104 which are oriented outwardly and provided on the upper edge of the outer walls. The outer walls of the filter holder 121 have a height which is greater than the height of the filter element 120. Thus a collection area 122 which is located underneath the filter element 120 is formed in the lower region of the filter holder 121. In particular, the collection area 122 is formed by the connection of the outer wall of the filter holder 121 and the inner wall of the filter holder 121 on which the filter element 120 is held, and comprises the base of the annular trough of the filter holder 121.

A cover 15 is applied to the upper face of the filter element 120. Said cover may be placed onto the filter element 120 or at least partially incorporated into the filter element 120 of hollow design. The filter holder 121 covers the gap 150 between the cover 15 and the recess 104, in a vertical top view of the cooking surface 10.

In the embodiment shown, an overflow container 13 is provided between the filter holder 121 and the fan housing 113. The overflow container 13 also has an annular trough shape. The overflow container 13 has a greater width than the filter holder 121. The filter holder 121 is received in the overflow container 13 at least in the lower region thereof in which the collection area 122 is formed. The overflow container 13 is arranged more deeply in the combined device 1 than the filter holder 121. As a result, a space is present between the base of the overflow container 13 and the collection area 122 of the filter holder 121. At least this space serves for receiving liquids. To this end, overflow openings (not shown) may be incorporated on the filter holder 121, in particular in the outer walls of the filter holder 121.

The filter unit 12 is releasably fastened to the combined device 1. For example, the filter unit 121 may be introduced into the recess 104 and suspended there. The overflow container 13 may be releasably connected to the combined device 1. Thus the overflow container 13, for example, may be loosely positioned on the fan housing 113 or suspended in the recess. The central through-passage which is produced by the annular shape of the overflow container 13 in this case is aligned with the air inlet opening 115 of the fan housing 113. However, it is also possible to connect the overflow container 13 fixedly, for example to the cover plate 103.

The annular trough shape, which the filter holder 121 and the overflow container 13 preferably contain, is understood both as a round shape and a square shape in a top view. The shape of the filter holder 121 and of the overflow container 13 are selected according to the shape of the recess 104.

Figure 4:
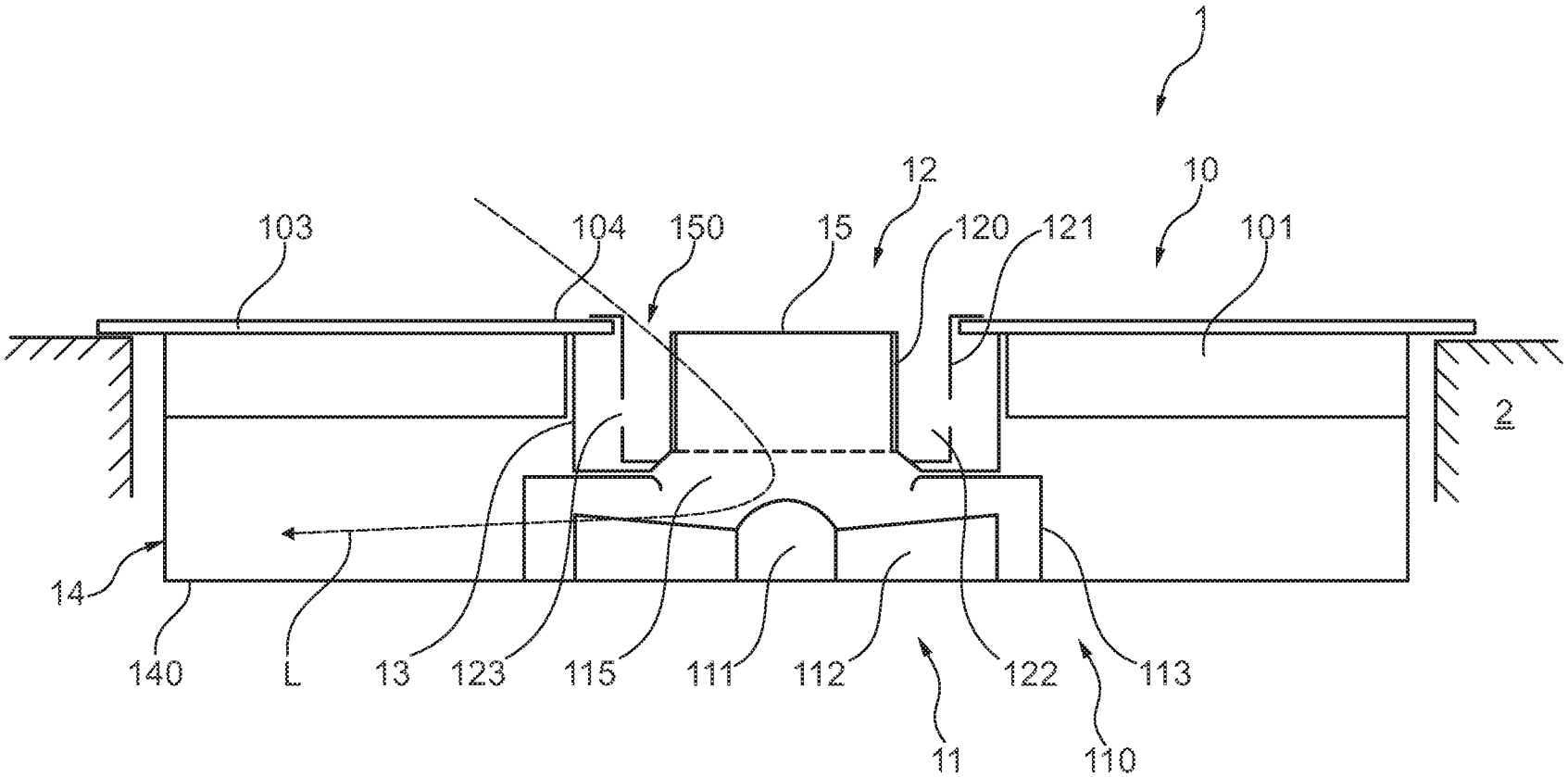
FIG. 4: shows a schematic sectional view of a third embodiment of the combined device according to the invention.

In FIG. 4 a third embodiment of the combined device 1 according to the invention is shown schematically in a sectional view. The combined device 1 is incorporated in an opening of a work surface 2. The construction of the fume extractor 11 and, in particular, of the fan 110 and the filter unit 12 and the overflow container 13 corresponds substantially to the construction of the second embodiment which has been described with reference to FIG. 3 in detail. The third embodiment differs from the second embodiment only in that the height of the filter element 120 in the filter unit 12 is so small that the filter element 120 does not protrude upwardly over the filter holder 121. Instead, in the third embodiment the upper face of the filter element 120 and the cover provided thereon are located underneath the plane of the cover plate 103 of the cooking surface 10.

In the third embodiment according to FIG. 4, an appliance housing 14 of the combined device 1, in which the fume extractor 11 and the cooking surface 10 are received, is also provided. In the embodiment shown, the heating elements 101 of the cooking surface 10 are received in the appliance housing 14 and the appliance housing 14 is covered from above by the cover plate 103. The fume extractor 11 is additionally provided in the appliance housing 14. In FIG. 4 of the fume extractor 11 only the fan 110 may be seen. The fan 110 is fastened to the appliance base 140 of the appliance housing 14.

Alternatively to the embodiment shown, in which the cooking surface 10 and the fume extractor 11 are received in an appliance housing 14, according to the invention it is also possible to design the combined device 1 without an appliance housing 14. In such an embodiment, for example, the upper face of the fan 110, i.e. the side in which the air inlet opening 115 is provided, may be fastened in the region which is located outside the air inlet opening 115 to the lower face of the cooking surface, in particular of a cooking surface housing (not shown).

In the embodiment shown in FIG. 4, the fan 110 is also arranged underneath the recess 104. In particular, the air inlet opening 115 of the fan housing 113, in a vertical top view of the recess 104, is located in the surface of the recess 104. In the third embodiment, the recess 104 is provided centrally in the cover plate 103, i.e. is located between two heating elements 101 of the cooking surface 10. In the depth direction of the combined device 1 the fan 110 arranged underneath the recess 104 may also be arranged centrally or offset to the front or to the rear (see FIG. 2*a*). In FIG. 2*a* possible positions of the fan 110 are indicated by showing the air inlet opening by dashed lines.

A recess 104 is incorporated in the cover plate 103 of the cooking surface 10, said recess in the third embodiment also being located in the middle of the surface of the cooking surface 10. The fan 110 is arranged centrally and in the embodiment shown on the appliance base 140, and thus is located centrally underneath the recess 104. The air inlet opening 115 is formed in the upper face of the fan 110, in particular of the appliance housing 113. A protective grille (not shown) may be provided in the air inlet opening 115. The filter unit 12 and the overflow container 13, which have been described in more detail with reference to FIG. 3, are arranged between the recess 104 and the air inlet opening 115.

The function of the combined device 1 is now described again.

In the fan 110, the fan wheel 112 is driven by a motor 111. As a result, air is suctioned into the fan housing 113 via the air inlet opening 115 of the fan housing 113 facing upwardly and thus toward the cooking surface 10. The air in this case is suctioned from above the cooking surface 10 through the recess 104 into the combined device 1. In particular, the air enters through the gap 150 between the edge of the recess 104 and the cover 15 into the combined device 1 and is suctioned toward the air inlet opening 115. Here, the suctioned airflow L passes through the filter element 120. The air thus cleaned is blown out via an air outlet opening (not shown) of the fan housing 113 and from there passes either indirectly via an outlet channel (not shown) or directly to an air outlet (not shown) of the appliance housing 14. From there the air may be discharged into the surroundings or into the space in which the combined device 1 is operated.

Liquids such as water and fat which are separated from the air on the filter element 120 are able to run down in the filter element 120. Since the filter element 120 is held on the filter holder 121 which has a collection area 122 underneath the filter element 120, the liquid may be collected there and does not enter the fan 110. If either a large quantity of liquid is separated on the filter or if liquid enters the combined device 1 in large quantities via the gap 150, for example when food boils over, initially the collection area 122 of the filter unit 12 is filled up. Overflow openings 123 are incorporated in the filter unit 12, in particular, in the outer wall of the filter holder 121. The height at which these overflow openings 123 are provided is preferably located in a plane which is lower than the lower edge of the filter element 120. If the liquid level in the collection area 122 reaches a height at which the overflow opening 123 is reached, the liquid runs into the overflow container 13 which is provided around the filter unit 12.

While the invention has been substantially described with reference to vertically extending filter elements 120, it goes without saying that other filter elements 120, such as for example filter elements which are located horizontally or at an angle, may also be used.

A solution is provided by the present invention in which the fan of the fume extractor is arranged directly underneath the recess in the cooking surface. Preferably, the recess is of rectangular design and has a longitudinal extent in the depth direction of the cooking surface. As a result, the recess and thus the suctioning area run along the cooking zones of the cooking surface.

Preferably, the recess is at least partially covered by a cover which may also be denoted as a lid. As a result, an entry of liquid into the recess and, in particular, into the fan located underneath the recess may be at least partially prevented. The cover is preferably releasably provided on the combined device, in particular on a filter unit of the combined device.

Depending on the arrangement and size of the cover in the recess, either two gaps which may also be denoted as slots are produced, or a rectangular gap is produced for suctioning the vapors. The filter unit, with the filter element which may also be denoted as a fat filter, is placed between the gap and the suctioning area of the fan, i.e. the air inlet opening of the fan housing. The filter element and preferably the entire filter unit are able to be removed from the combined device.

Preferably, a collection area may be provided for liquids which may also be denoted as a liquid container. In this collection area, fat or water which penetrates into the gap between the cover and recess may be trapped and collected. The liquid container is preferably removable from the combined device.

In the case of too large a quantity of liquid which penetrates through the gap, preferably at least one overflow opening which may also be denoted as the overflow hole, is provided on the collection area, so that this liquid may flow into an overflow container. The overflow container is preferably fixedly mounted in the combined device and therefore is also denoted as a fixed container. The fixed container is preferably not dismantlable but may be cleaned by hand or emptied from underneath via an opening.

The filter element, the collection area and the lid may be a single unit. Alternatively, however, it is also possible that only the lid and the collection area form a unit.

Preferably, for safety reasons, the fan is prevented from being switched on in the state in which the filter, the collection area and the lid are removed. This may be implemented by a switch.

The present invention has a series of advantages. In particular, due to the positioning of the fan underneath the recess and the alignment of the air inlet opening at the top, potentially only one fan is required. This fan may be larger, rotate more slowly and thus produce less noise. Additionally, the fan may be protected, for example, by a filter unit and/or an overflow container. Additionally, the shape of the recess may be constituted by an elongated shape, whereby this recess runs alongside in the vicinity of the cooking zones of the cooking surface. Due to the arrangement of the fan according to the invention directly underneath the recess, a reliable extraction may be ensured even in the case of such a slot. In particular, in the arrangement according to the invention, the flow path through which the air has to pass when extracted by the fan is simple and, in particular, has no directional alterations or only slight directional alterations.

The invention claimed is:

1. An apparatus, the apparatus comprising:

a cooking surface having a recess;

a fume extractor arranged underneath at least a portion of the recess of the cooking surface for extracting air from a space above the cooking surface via the recess and including at least one fan with an upwardly facing air inlet opening; and a filter unit disposed between the at least one fan of the fume extractor and the cooking surface, the filter unit comprising a filter element, a collection area surrounding the filter element and extending downward from the cooking surface, and a cover attached to an upper face of the filter element.

2. The apparatus of claim 1, wherein the upwardly facing air inlet opening is one of parallel to the cooking surface and inclined at an angle of less than 90° relative to a horizontal surface of the cooking surface.

3. The apparatus of claim 2, wherein the upwardly facing air inlet opening of the at least one fan is located entirely underneath the recess when viewed in a vertical direction.

4. The apparatus of claim 2, wherein the apparatus has a midsection underneath the recess of the cooking surface and the at least one fan is disposed in the midsection with the recess sized to extend over the midsection.

5. The apparatus of claim 1, wherein the fume extractor and the cooking surface are fastened together as a complete assembly unit.

6. The apparatus of claim 5, wherein the cooking surface and the fume extractor are connected together directly or indirectly.

7. The apparatus of claim 5, further comprising a common appliance housing configured to connect the cooking surface and the fume extractor.

8. The apparatus of claim 5, further comprising a common electrical power connection for the cooking surface and the fume extractor.

9. The apparatus of claim 8, wherein the at least one fan of the fume extractor is fastened to a base of the appliance housing.

10. The apparatus of claim 1, wherein the cover is configured to cover at least part of the recess.

11. The apparatus of claim 10, wherein the cover has a dimension which at least in one surface direction is smaller than a dimension of the recess.

12. The apparatus of claim 1, further comprising an overflow container arranged at least partially underneath the filter unit.

13. The apparatus of claim 1, wherein the at least one fan is a radial fan.

14. The apparatus of claim 1, further comprising:

a plurality of fans each having an upwardly facing air inlet opening arranged underneath at least a portion of the recess of the cooking surface for extracting the air from the space above the cooking surface via the recess.

15. The apparatus of claim 1, wherein a portion of the collection area is disposed underneath the filter element.

* * * * *